US005848907A

United States Patent [19]

Chen

[11] Patent Number: 5,848,907

[45] Date of Patent: Dec. 15, 1998

[54] ADAPTER WITH INTERCHANGEABLE PLUG BOARD

[75] Inventor: David Chien Hua Chen, Taipei, Taiwan

[73] Assignee: Board-Tech Electronic Co., Ltd., Taipei, Taiwan

[21] Appl. No.: 778,674

[22] Filed: Jan. 3, 1997

[30] Foreign Application Priority Data

May 24, 1996 [TW] Taiwan ..... 85207757

[51] Int. Cl.[6] ..... H01R 29/00

[52] U.S. Cl. ..... 439/172; 439/518; 439/929

[58] Field of Search ..... 439/170, 172, 439/173, 174, 695, 956, 518, 929

[56] References Cited

U.S. PATENT DOCUMENTS

| | | | |
|---|---|---|---|
| 3,952,239 | 4/1976 | Owings et al. | 439/929 |
| 4,911,649 | 3/1990 | Helmich, Jr. | 439/172 |
| 4,973,827 | 11/1990 | Nozaki | 439/172 |
| 5,613,863 | 3/1997 | Klaus et al. | 439/172 |
| 5,634,806 | 6/1997 | Hahn | 439/172 |
| 5,702,259 | 12/1997 | Lee | 439/172 |

*Primary Examiner*—Neil Abrams
*Attorney, Agent, or Firm*—Beveridge, DeGrandi, Weilacher & Young, LLP

[57] ABSTRACT

An adapter with interchangeable plug board (3) that can be easily interchanged for various types of receptacles is provided. The adapter includes a casing (1), a cover (2), and a plug board (3). The casing (1) is formed with first insetting means such as a plurality of slots **(13, 14*b*, 14*c*). In addition, an upright slide slot (16) is formed on one sidewall of the casing (1). A sliding piece (17) is slidably inset in the slide slot (16). The sliding piece (17) is formed with a stop tongue (170) on the top and is lockable at least at a top position and a lower position. The plug board (3) has a base board (30) and a plurality of plug pins (31) erected thereon. Further, the base board (30) is formed with second insetting means such as a plurality of tongues (33, 34) for forming a tongue-and-slot joint with the first insetting means on the casing (1). A stop slot (35) is formed near the rear edge of the base board (30). The first and second insetting means allow the plug board (3) to be easily mounted in position in the casing (1). The sliding piece (17) allows the plug board (3) to be locked in position in the casing (1), and also allows the plug board (3) to be easily detached from the casing (1)** for replacement with another plug board.

7 Claims, 5 Drawing Sheets

ADAPTER WITH INTERCHANGEABLE PLUG BOARD

BACKGROUND OF THE INVENTION

1. Field of the Invention

This invention relates to adapters for electrical outlets, and more particularly, to an adapter with an interchangeable plug board that can be easily interchanged for various types of receptacles.

2. Description of Related Art

Specifications of electrical plugs and receptacles are different in different countries. Therefore, when one person travels to another country, the electrical plugs on his/her personal electrical appliances may not be able to fit into the receptacles on the electrical outlets in that country.

To solve the foregoing problem, an adapter as shown in FIG. 1 is provided. This adapter includes a cover 1', a casing 2', and a plug board 3', and conductive pieces (not shown). The cover 1' is formed with a plurality of insertion holes 10' which allow various types of plugs to be inserted thereinto. The casing 2' has a lateral wall formed with a slot 20' and insetting slits 21' and a bottom side formed with a pair of engaging slots 22'. When assembling the plug board 3' with the casing 2', the tongue-like piece 30', the two insetting pieces 31', and the two engaging pieces 32' are fitted respectively in the slot 20', the insetting slits 21', and the engaging slots 22' of the casing 2'. The conductive frames are mounted in the casing 2' for electrically connecting plug pins of a plug inserted into the adapter through the insertion holes 10' with pins erected on the plug board 3'. This adapter allows the user to interchange the plug board 3' with another one mounted with other type of plug pins. However, one drawback to this adapter is that detaching the plug board 3' is quite a laborious work to do, in that the disengaging of the engaging pieces 32' from the engaging slots 22' should be done by using, for example, a driver tool as an assistant. This is quite inconvenient for the user since the driver tool may not be always on hand with the user. Moreover, after frequent interchanging of the plug board 3', the engaging pieces 32' could break, which will cause the adapter to be unusable.

Further, the adapter is provided with three elastic pieces 4'. When the plug board 3' is attached to the casing 2', the conductive pieces (not shown) are electrically connected by way of these elastic pieces 4' to the fixed end 34' of the pins 33' on the plug board 3'. These elastic pieces 4', however, usually fall off position when the plug board 3' is detached from the casing 2' for replacement since they are floatingly mounted in the casing 2' without fastening means.

SUMMARY OF THE INVENTION

It is therefore a primary objective of the present invention to provide an adapter with an interchangeable plug board mounted with a plurality of plug pins that can be easily interchanged with one another and mounted with different plug pins for various types of receptacles.

It is another objective of the present invention to provide an adapter with an interchangeable plug board that is durable for frequent interchanging for various types of receptacles.

It is still another objective of the present invention to provide an adapter with an interchangeable plug board which is provided with secured elastic conductive pieces that will fall off from position when detaching the plug board from the casing.

In accordance with the foregoing and other objectives of the present invention, a new and improved adapter with an interchangeable plug board is provided.

The adapter includes a casing, a plurality of conductive frames, a cover, and a plug board. The casing has a bottom wall and four sidewalls formed on the bottom wall. Further, the casing is formed with first insetting means including a plurality of slots or tongues on the bottom wall. In addition, an upright slide slot having an opening connected to the bottom wall is formed on one of the sidewalls. A retaining means is slidably inset in the slide slot. The retaining means is a sliding piece having a top end formed with a stop tongue or a stop slot and which is lockable at least at an upper position and a lower position by means of the engagement of at least a protruded portion protruded from at least one side of the sliding piece with at least two recesses formed on at least one sidewall of the slide slot, or alternatively of at least a recess formed on at least one side of the sliding piece with at least two protruded portions protruded from at least one side wall of the slide slot. The plug board has a base board and a plurality of plug pins erected on the base board. Further, the base board is formed with second insetting means including a plurality of tongues or slots for forming a tongue-and-slot joint with the first insetting means on the casing, and, a stop slot or a stop tongue for receiving the stop tongue or stop slot of the sliding piece is formed near the rear edge of the base board. In addition, the conductive frames are mounted in the casing for electrically connecting plug pins of a plug inserted into the casing through insertion slots formed on the cover with the plug pins on the plug board.

The plug board is mounted in position on the casing by engaging the second insetting means on the plug board with the first insetting means on the casing and by shifting the sliding piece to the top position in which the stop tongue is inserted in the stop slot on the plug board.

When the user wishes to replace the plug board with another one with a different type of plug pins, he/she needs just to push the sliding piece downwards, allowing the protruded portion on the sliding piece to be shifted from the engagement with upper recess to the engagement with the lower recess formed on the slide slot, or allowing the recess on the sliding piece to be shifted. This withdraws the stop tongue from the stop slot on the back of the plug board. The plug board thus can be freely removed by the user for exchange.

The adapter can also be used as a plug. In such case, the casing is consisted of a top wall, a bottom wall and four sidewalls, and a couple of conductive pieces are mounted in the casing. Further, an electrical cord is connected with the adapter through an insertion hole formed on the top wall of the casing of the adapter.

BRIEF DESCRIPTION OF DRAWINGS

The invention can be more fully understood by reading the following detailed description of the preferred embodiments, with reference made to the accompanying drawings, where.

DETAILED DESCRIPTION OF PREFERRED EMBODIMENT

Figure 1:
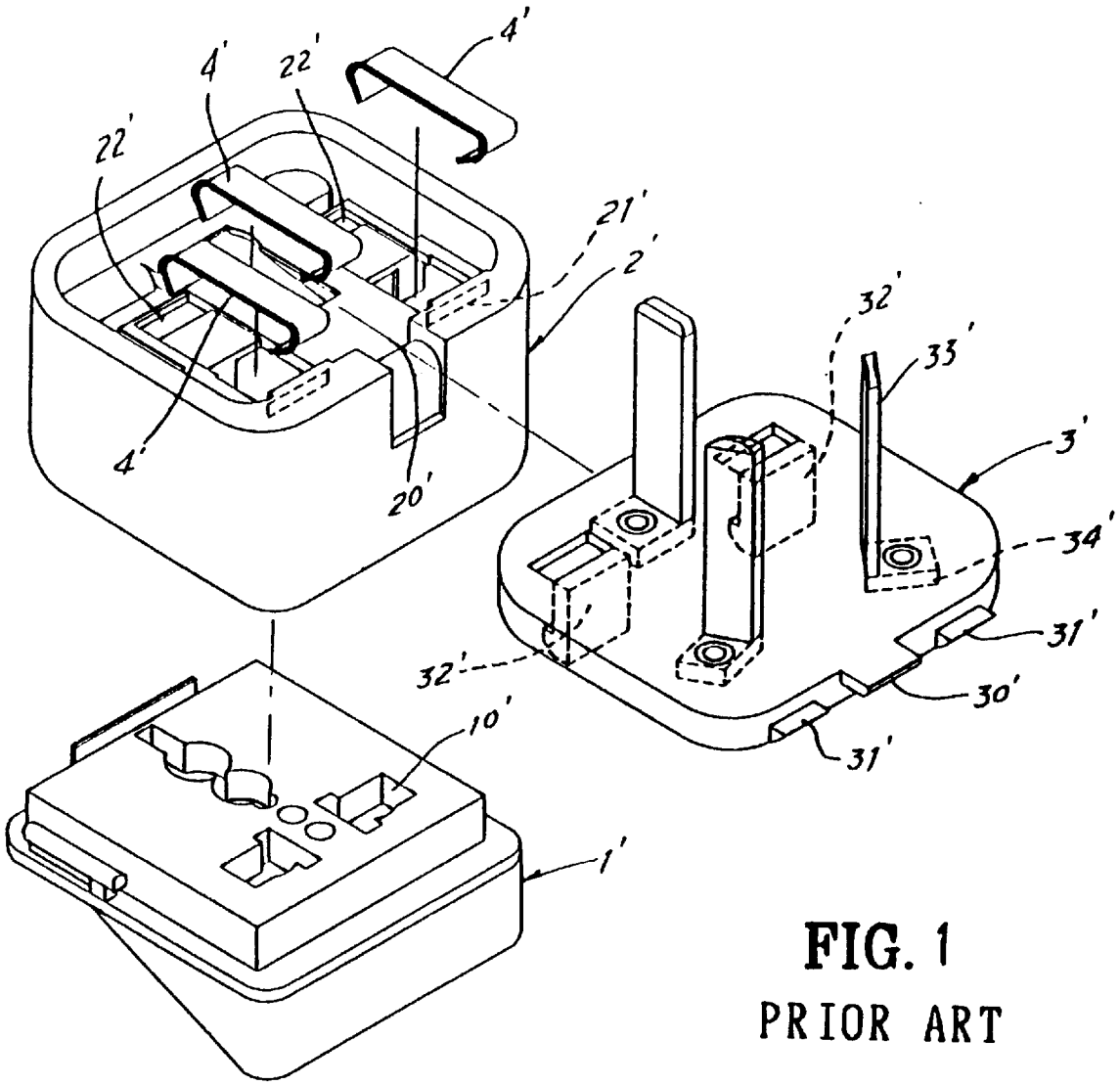
FIG. 1 PRIOR ART
FIG. 1 is an exploded perspective view of a conventional adapter for electrical outlets.
Figure 2:
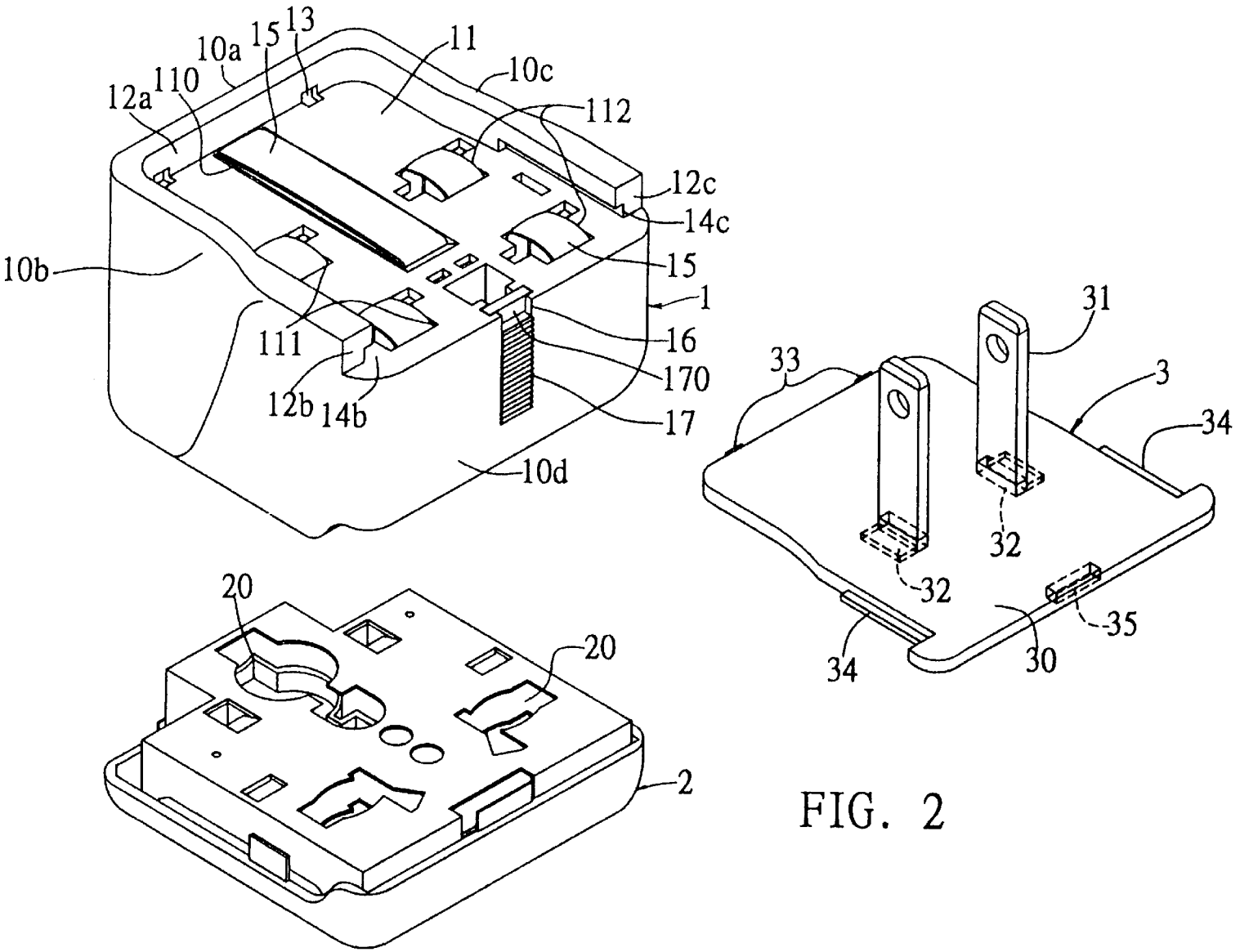
FIG. 2 is an exploded perspective view of the adapter according to the present invention.
Figure 3:
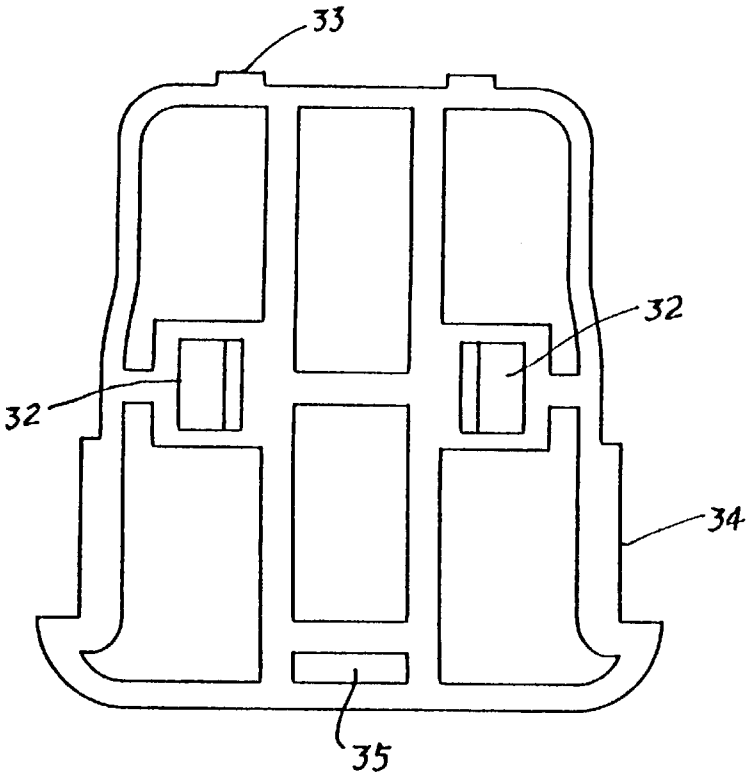
FIG. 3 is a top view of the plug board of the adapter of FIG. 2.

Referring to FIGS. 2 and 3, the adapter of the invention includes a casing 1, a cover 2 covering on one side of the casing 1, and a plug board 3 which can be electrically connected with the conductive pieces (not shown) in the casing 1 when assembled with the casing 1.

Figure 5:
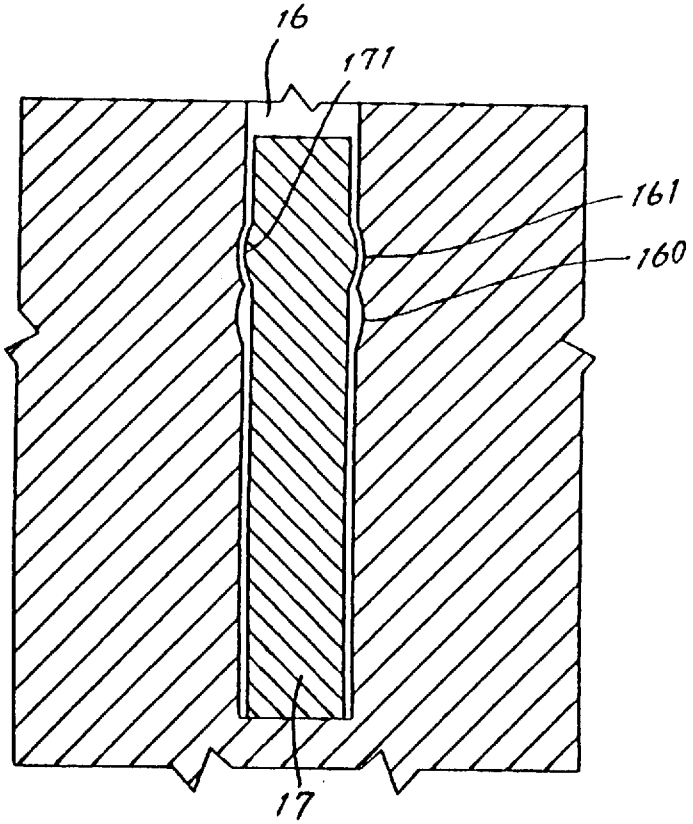
FIG. 5 is a cross sectional view of the adapter of FIG. 4 cutting through the line A—A.
Figure 7:
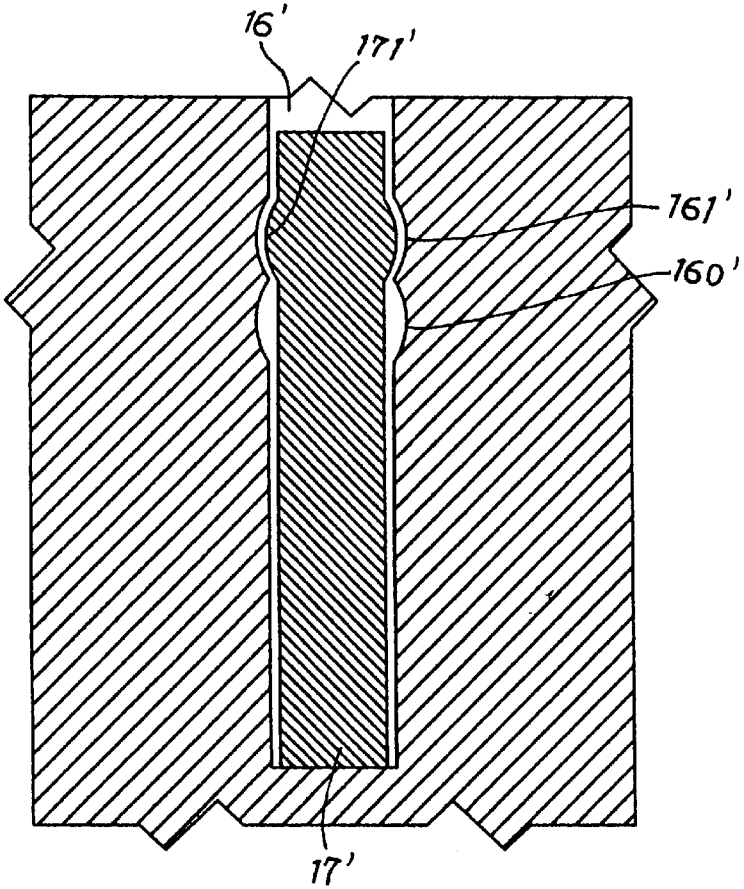
FIG. 7 is a cross sectional view of another adapter embodiment of FIG. 4 cutting through the line A—A.

The casing 1 is substantially a cubic body having a bottom wall 11 (shown upside down in FIG. 2) and four upright sidewalls 10*a*, 10*b*, 10*c*, and 10*d*. Branch walls 12*a*, 12*b*, 12*c* are formed on the bottom wall 11, which are extensions of the sidewalls 10*a*, 10*b*, 10*c*. Further, a pair of insetting holes 13 are formed in the branch wall 12*a*, and two insetting slots 14*b*, 14*c* are respectively formed in the branch walls 12*b*, 12*c*. The bottom wall 11 is formed with an elongated slot 110 in the middle and two pairs of substantially square slots 111, 112 near two edges. These slots 110, 111, 112 expose the contact portions 15 of the conductive pieces in the casing 1. A slide slot 16 is formed upright in the middle of the sidewall 10*d*; and a sliding piece 17 is slidably inset in the slide slot 16. A stop tongue 170 is formed on the top of the sliding piece 17. Further, as shown in FIG. 5, the sliding piece 17 is formed with a pair protruded portions 171 on the two sides thereof near the top, and each sidewall of the slide slot 16 is formed with a first recess 160 and a second recess 161. The two recesses 160, 161 allow the sliding piece 17 to stop at two positions defined thereby when sliding in the slide slot 16. In an alternative embodiment as shown in FIG. 7, the sliding piece 17' is formed with a pair of recesses 171' on the two sides thereof near the top, and each sidewall of the slide slot 16' is formed with a first projection 160' and a second projection 161'. The two projections 160', 161' allow the sliding piece 17' to stop at two positions defined thereby when sliding in the slide slot 16'.

The cover 2 is formed with insertion holes 20, and is mounted on the casing 1 by means of high-frequency welding, glues, or other fastening means.

As shown in FIGS. 2 and 3, the plug board 3 includes a base board 30 on which plug pin 31 are erected. Each plug pin 31 has a rear end 32 fixed to the base board 30 and exposed on the back of the base board 30 as shown in FIG. 3. When the plug board 3 is mounted on the casing 1, the exposed portion of the rear end 32 of each plug pin 31 comes into electrical contact with one of the contact portions 15 on the bottom wall 11 of the casing 1. The base board 30 is formed with a pair of first tongues 33 on the front edge and a pair of second tongues 34, which are elongated, respectively on the lateral edges. Further, a slot 35 is formed near the rear edge of the base board 30 for receiving the stop tongue 170 on the sliding piece 17.

Figure 4:
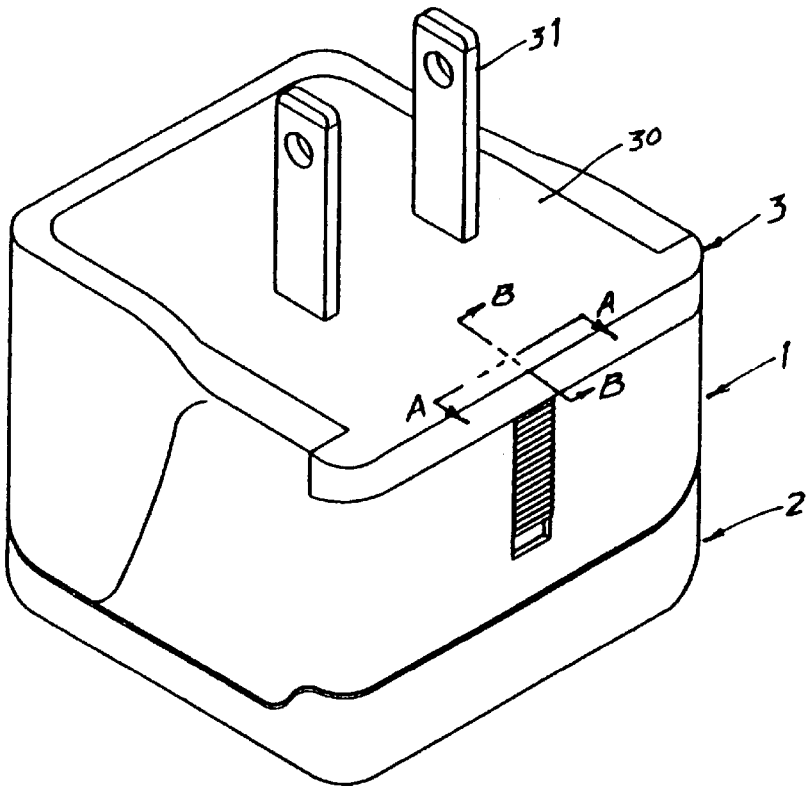
FIG. 4 is a perspective view of the adapter of FIG. 2 when assembled.
Figure 6:
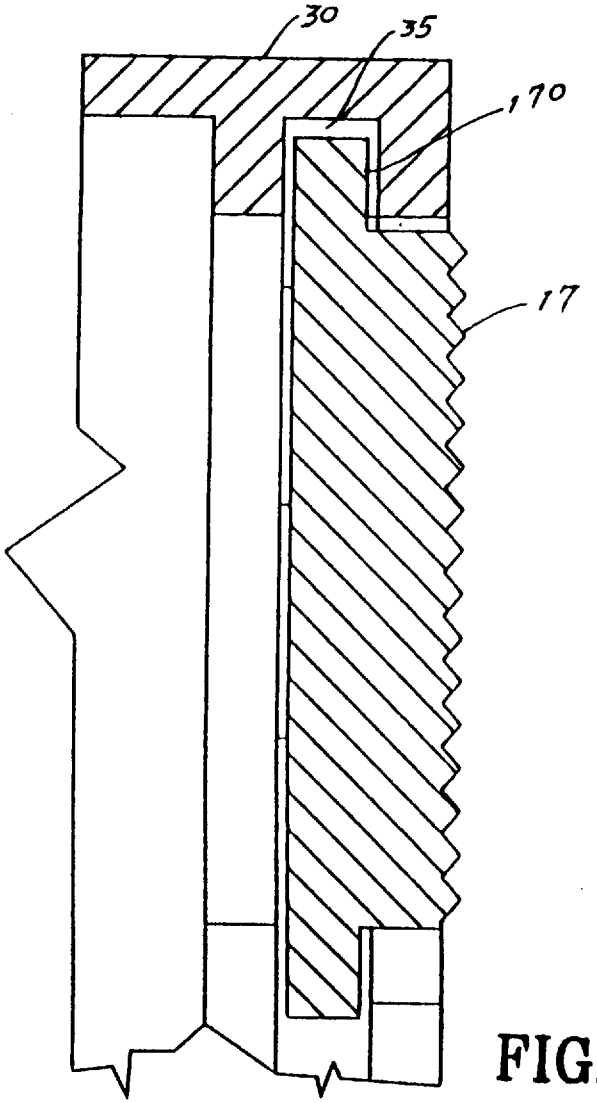
FIG. 6 is a cross sectional view of the adapter of FIG. 4 cutting through the line B—B.

In assembly, the cover 2 is attached to the bottom wall 11 of the casing 1. Then the plug board 3 is mounted onto the casing 1 by inserting the first tongues 33 on the plug board 3 into the insetting holes 13 in the casing 1 and the second tongues 34 into the insetting slots 14*b*, 14*c*. After that, the sliding piece 17 is pushed upwards so as to allow the protruding portion 171 thereof to be shifted from the first recess 160 to the second recess 161, thereby allowing the stop tongue 170 on the sliding piece 17 to be inserted into the slot 35 on the back of the plug board 3, as illustrated in FIG. 6. The plug board 3 is thus secured in position. This completes the assembly of the adapter, as illustrated in FIG. 4.

Figure 8:
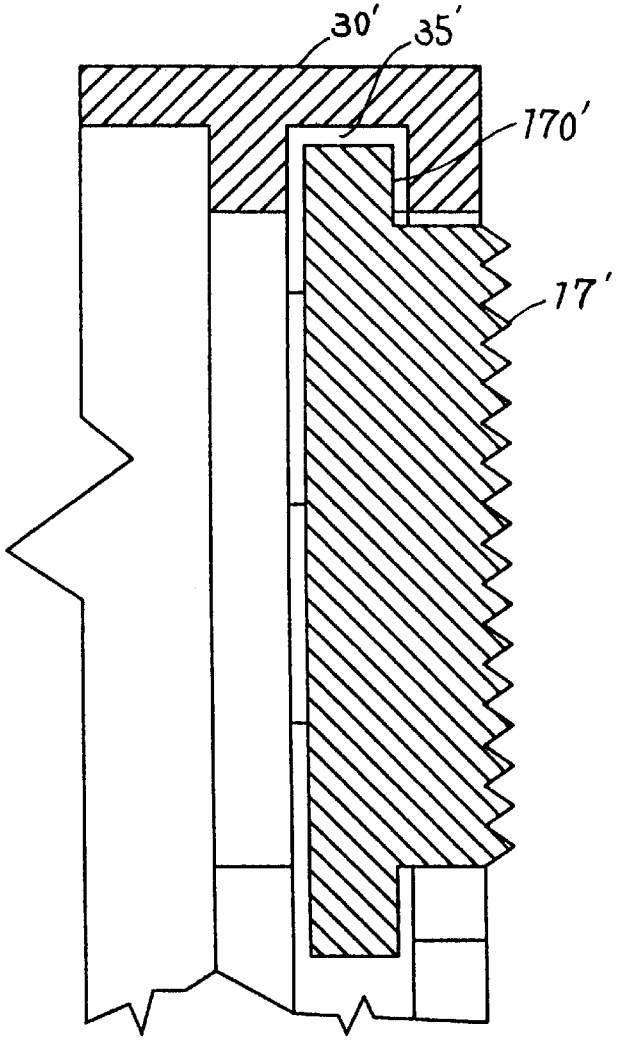
FIG. 8 is a cross sectional view of another adapter embodiment of FIG. 4 cutting through the line B—B.

In the alternative embodiment as shown in FIG. 8, the sliding piece 17' is pushed upwards so as to engage the stop tongue 35' of the plug board 3 in the stop slot 170'.

When the user wishes to replace the plug board 3 with another one with a different type of plug, he/she needs just to push the sliding piece 17 downwards, allowing the protruded portion 171 on the sliding piece 17 to be shifted from the second recess 161 to the first recess 160. This withdraws the stop tongue from the slot 35 on the back of the plug board 3. The plug board 3 thus can be freely removed by the user. The new plug board can be mounted in the same way as described earlier.

When the plug board 3 is inserted in position on the casing 1, the rear end 32 of each of the blades 31 comes into electrical contact with the contact portions 15 of the conductive pieces (not shown) in the casing 1.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. An adapter with interchangeable plug board, comprising:

a casing having a bottom wall and four sidewalls, said casing being formed with first insetting means on said bottom wall and an upright slide slot on one of said sidewalls;

a plug board having a base board and a plurality of plug pins erected on said base board, said base board being formed with second insetting means for engaging said first insetting means;

a plurality of conductive frames mounted in said casing;

a cover covering said casing; and a retaining means slidably inset in said slide slot for retaining said plug board, said retaining means being lockable at least at an upper position and a lower position with respect to said sidewall formed with said slide slot; wherein said plug board is mounted in position on said casing by engaging said second insetting means of said plug board with said first insetting means of said casing and by shifting said retaining means to the upper position in which said plug board is retained by said retaining means; and said plug board is detached from said casing by shifting said retaining means to the lower position in which said plug board is released from said retaining means, thereby allowing said plug board to be manually removed.

2. The adapter of claim 1, wherein said bottom wall of said casing is formed with a plurality of holes for exposing said conductive frames thereon.

3. The adapter of claim 2, wherein said conductive frames come into electrical connection with the plug pins on said plug board when the plug board is mounted on said casing.

4. The adapter of claim 1, wherein said slide slot has at least a sidewall formed with at least a first recess and a second recess, said first recess defining the upper position and said second recess defining the lower position; and said retaining means has at least one lateral side formed with a protruded portion, thereby when said protruded portion is received by said first recess, said retaining means being locked at the upper position, and when received by said second recess, said retaining means being locked at the lower position.

5. The adapter of claim 1, wherein said slide slot has at least a sidewall formed with at least a protruded portion; and said retaining means has at least one side formed with at least a first recess and a second recess, thereby when said protruded portion is received by said first recess, said retaining means being locked at the upper position, and when received by said second recess, said retaining means being locked at the lower position.

6. The adapter of claim 1, wherein said retaining means is a sliding piece, a top end of said sliding piece formed with a stop tongue for engagement with a stop slot formed on a bottom surface of said plug board.

7. The adapter of claim 1, wherein said retaining means is a sliding piece, a top end of said sliding piece formed with a stop slot for engagement with a stop tongue formed on a bottom surface of said plug board.

* * * * *